United States Patent [19]

Carteus et al.

[11] 4,060,057

[45] Nov. 29, 1977

[54] WATER SUPPLY PIPE FOR A STEAM GENERATOR

[75] Inventors: Marc Félix Maurice Carteus; Yvrs Marie Grovgrs De Bruyne, both of Brussels; Jean Pierre Gustaaf Rosa Lemmens, Heverlee; Elie Jozef Stubbe, Sterrebeek, all of Belgium

[73] Assignee: Societe de Traction et D'Electricite S.A., Brussels, Belgium

[21] Appl. No.: 685,605

[22] Filed: May 12, 1976

[30] Foreign Application Priority Data

May 12, 1975 Belgium ..... 156239

[51] Int. Cl.[2] ..... F22D 5/00

[52] U.S. Cl. ..... 122/451 R; 122/406 B; 138/42

[58] Field of Search ..... 138/38, 42; 137/247, 137/247.11, 251, 254; 122/406 R, 406 B, 451, 458

[56] References Cited

U.S. PATENT DOCUMENTS

| | | | |
|---|---|---|---|
| 356,400 | 1/1887 | Butler | 122/458 |
| 2,664,109 | 12/1953 | Iager | 138/42 |
| 3,062,233 | 11/1962 | Hammersly | 137/592 |
| 3,144,904 | 8/1964 | Kahn et al. | 138/42 |

*Primary Examiner*—Kenneth W. Sprague
*Attorney, Agent, or Firm*—Sughrue, Rothwell, Mion, Zinn and Macpeak

[57] ABSTRACT

The present invention relates to a water supply pipe for a steam generator.

The supply pipe comprises the following elements in a substantially horizontal portion (3) thereof:

a lower baffle plate (4) defining or limiting an upper opening (7), and an upper baffle plate (5) defining or limiting a lower opening (9) and being disposed upstream of the lower baffle plate with respect to the normal flow direction of the water.

The horizontal edge (8) defining the upper opening is disposed higher than the horizontal edge (10) defining the lower opening.

As a result, the two baffle plates form between them a hydraulic barrier, which, when the water supply is cut off or reduced, prevents or substantially limits the passage of steam coming from the generator.

3 Claims, 5 Drawing Figures

FIG. 1
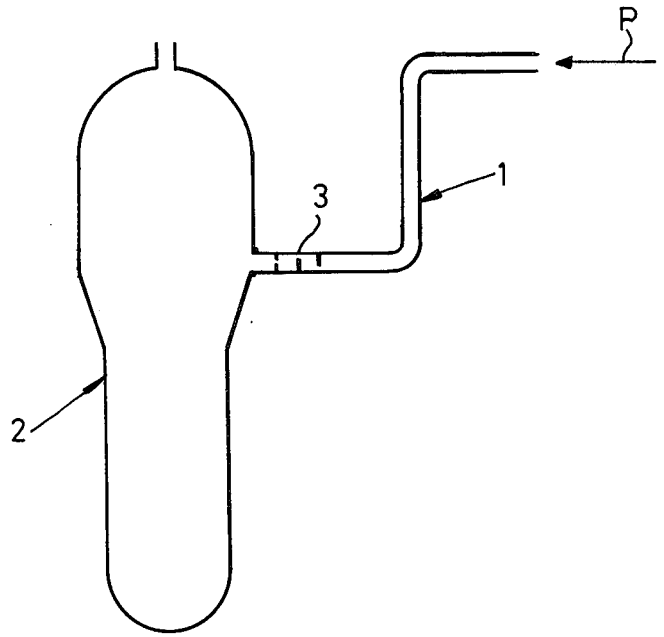
FIG. 2
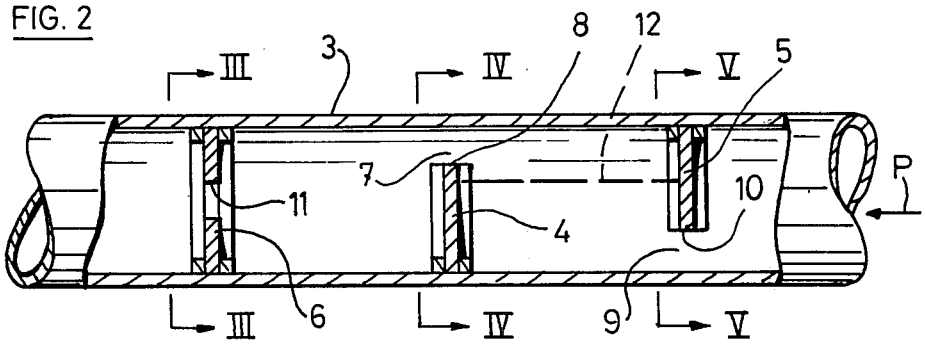
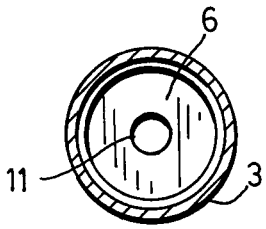
FIG. 3
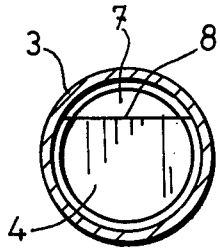
FIG. 4
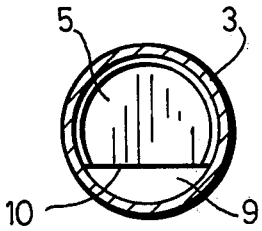
FIG. 5

WATER SUPPLY PIPE FOR A STEAM GENERATOR

BACKGROUND OF THE INVENTION

1. Field of the Invention

The present invention relates to a water supply pipe for a steam generator.

2. Description of the Prior Art

During operation of a steam generator it frequently happens that when the water supply is cut off or reduced, a quantity of steam is admitted to the water supply pipe and it passes to the upper part of this pipe. As a result, when the water supply is returned to normal operation, the presence of the steam in the upper part of the supply pipe causes knocking in the pipe which can adversely affect the normal operation of the generator and can produce deterioration of the equipment employed.

A solution has already been proposed for preventing steam from flowing from the generator into the supply pipe and for eliminating or at least reducing the possibility of subsequent knocking in the pipe. This known solution consists of inserting an automatic one-way valve in the supply pipe in the vicinity of the generator. This know solution has disadvantages. The one-way valve, which is complicated and bulky, is an active mechanical element which requires a movement in order to carry out its operations of opening and closing the supply pipe and which is less reliable than equivalent static means. In addition, the one-way valve in point only provides comparative seal tightness to the passage of steam.

SUMMARY OF THE INVENTION

The present invention relates to an economic and effective improvement to the water supply pipe which is designed to largely eliminate the passage of steam coming from the generator and, as far as possible, to reduce knocking in comparison to the known case.

Accordingly, a water supply pipe according to the invention comprises a lower baffle plate and an upper baffle plate in a horizontal or substantially horizontal portion.

The lower baffle plate defines or limits an upper opening and the upper baffle plate defines or limits a lower opening and is disposed upstream of the lower baffle plate with respect to the normal flow direction of the water. In addition, the lower horizontal edge defining the upper opening is higher than the upper horizontal edge defining the lower opening. As a result, the two baffle plates form between them a hydraulic barrier which, when the water supply is cut off or reduced, blocks the passage of steam coming from the generator or substantially limits this steam which then condenses upstream of the upper baffle plate in contact with the water and restores the hydraulic seal.

To regulate the water flow rate during normal operation, the supply pipe according to the invention comprises an annular transversal diaphragm disposed downstream of the lower baffle plate with respect to the normal direction of flow of the water.

In the supply pipe according to the invention, the portion comprising the diaphragm and baffle plates is preferbly disposed adjacent to the steam generator.

Other objects, features and advantages of the present invention will be made apparent in the course of the following detailed description thereof which is provided with reference to the accompanying drawings which diagrammatically represent an embodiment of the invention provided by way of example only.

BRIEF DESCRIPTION OF THE DRAWINGS

FIG. 1 is an elevational view of a steam generator equipped with a water supply pipe according to the invention.

FIG. 2 is an axial sectional view of a specific portion of the supply pipe according to the invention.

FIGS. 3, 4 and 5 are transversal sectional views of the abovementioned portion along the lines III—III, IV—IV and V—V, respectively, of FIG. 2.

DESCRIPTION OF THE PREFERRED EMBODIMENT

The same reference numbers are used to designate identical elements in the different figures.

The pipe according to the invention, which is designated generally by the reference number 1, is used to supply a conventional steam generator 2, for example, in a nuclear power station.

According to the invention, the supply pipe 1 comprises a horizontal or substantially horizontal portion 3 adjacent to the generator 2.

The portion 3 comprises a lower baffle plate 4, an upper baffle plate 5 and an annular diaphragm 6.

The lower baffle plate 4 is disposed between the upper baffle plate 5 and the annular diaphragm 6 and extends transversally from the lower and lateral parts of the portion 3 to within a specific distance from the upper part of this portion 3. Thus, the lower baffle plate 4 partially blocks the portion 3, more specifically, at its lower part. The lower baffle plate 4 thus defines an upper opening 7 and the straight upper horizontal edge 8 of 4 forms the lower limit of this upper opening 7.

The upper baffle plate 5 is disposed upstream of the lower baffle plate 4 with respect to the normal flow direction of the water in the supply pipe 1; this direction being indicated by the arrow P.

The upper baffle plate 5 extends transversally from the upper and lateral parts of the portion 3 to within a specific distance from the lower part of this portion 3. Thus, the upper baffle plate 5 also partially blocks the portion 3, more specifically, at its upper part. The upper baffle plate 5 defines a lower opening 9 and the lower straight horizontal edge 10 of this baffle plate 5 forms the upper limit of this lower opening 9.

In addition, the upper horizontal edge 8 of the lower baffle plate 4 is disposed higher than the lower horizontal edge 10 of the upper baffle plate 5; these edges 8 and 10 also being disposed on either side of the axis of portion 3.

The annular diaphragm 6 is disposed downstream of both the upper baffle plate 5 and lower baffle plate 4 with respect to the normal flow direction of the water in the supply pipe 1. The annular diaphragm 6 extends transversally to within a specific distance from the axis of the portion 3. The edge 11 of the annular diaphragm 6 is centered on this axis. The annular diaphragm 6 partially and marginally blocks the portion 3.

The lower baffle plate 4 and the upper baffle plate 5 form between them a hydraulic barrier 12 which is produced when the water supply to the generator is cut off or reduced. When the water supply is cut off or reduced, the steam produced by the generator 2 enters the end part of the supply pipe 1 but is stopped by the two above-mentioned baffle plates 4 and 5 and by a quantity of water disposed between the latter at a level situated between the horizontal edges 8 and 10. The lower baffle plate 4 and the upper baffle plate 5 thus together form the hydraulic seal or barrier 12 which prevents or at least largely limits the passage of steam into the supply pipe 1; this steam condensing in contact with the water immediately upstream of the upper baffle plate 5, thus restoring the hydraulic barrier 12.

In addition, the annular diaphragm 6 is used to regulate the flow rate of the water supplying the generator 2 during normal operation.

The present invention is obviously not limited to the embodiment which has been represented and various modifications can be made to the form, disposition and configuration of certain elements used therein as long as these modifications fall within the scope of the following claims.

What is claimed is:

1. In combination, a steam generator, a water supply pipe coupled to said steam generator for supplying water thereto, the improvement wherein said water supply pipe comprises the following elements:

a horizontal or substantially horizontal pipe portion, a lower baffle plate disposed in the pipe portion, an upper opening defined by the lower baffle plate, a horizontal lower edge defining the upper opening, an upper baffle plate disposed in the pipe portion upstream of the lower baffle plate with respect to the normal flow direction of the water, a lower opening defined by the upper baffle plate, a horizontal upper edge which defines the lower opening and which is situated lower than the horizontal lower edge such that the two baffle plates together form a hydraulic barrier which, when the water supply is cut off or reduced, prevents or substantially limits the passage of the steam produced by the generator, this steam then condensing upstream of the upper baffle plate in contact with the water and restoring the hydraulic barrier.

2. The combination as claimed in claim 1, characterized in that it comprises an annular diaphragm mounted transversally downstream of the lower baffle plate with respect to the normal flow direction of the water, this annular diaphragm regulating the flow rate of the water supply during normal operation.

3. The combination as claimed in claim 1, characterized in that its portion comprising the diaphragm and baffle plates is adjacent to the steam generator.

* * * * *